US011769939B2

(12) United States Patent
Chang et al.

(10) Patent No.: US 11,769,939 B2
(45) Date of Patent: Sep. 26, 2023

(54) ELECTRONIC DEVICE AND ANTENNA STRUCTURE

(71) Applicant: WISTRON NEWEB CORPORATION, Hsinchu (TW)

(72) Inventors: Hsuan-Jui Chang, Hsinchu (TW); Hsieh-Chih Lin, Hsinchu (TW); Guan-Ren Su, Hsinchu (TW); Wei-Shan Chang, Hsinchu (TW); Yi-Feng Wu, Hsinchu (TW); Shang-Sian You, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 17/835,239

(22) Filed: Jun. 8, 2022

(65) Prior Publication Data

US 2023/0216173 A1 Jul. 6, 2023

(51) Int. Cl.

| | |
|---|---|
| ***H01Q 1/24*** | (2006.01) |
| ***H01Q 1/22*** | (2006.01) |
| ***H01Q 13/10*** | (2006.01) |
| ***H01Q 9/42*** | (2006.01) |
| ***H01Q 3/22*** | (2006.01) |
| ***H01Q 5/35*** | (2015.01) |

(52) U.S. Cl.

CPC ..... *H01Q 1/2258* (2013.01); *H01Q 1/243* (2013.01); *H01Q 3/22* (2013.01); *H01Q 5/35* (2015.01); *H01Q 9/42* (2013.01); *H01Q 13/10* (2013.01)

(58) Field of Classification Search

CPC ..... H01Q 13/10; H01Q 9/42; H01Q 3/22; H01Q 1/243; H01Q 5/35; H01Q 1/2258

See application file for complete search history.

(56) References Cited

U.S. PATENT DOCUMENTS 10,629,990 B2 4/2020 Chun et al.

FOREIGN PATENT DOCUMENTS

| | | |
|---|---|---|
| TW | I614940 B | 2/2018 |
| TW | M583629 U | 9/2019 |
| TW | I742159 B | 10/2021 |

*Primary Examiner* — Graham P Smith

(74) *Attorney, Agent, or Firm* — McClure, Qualey & Rodack, LLP

(57) ABSTRACT

An electronic device and an antenna structure are provided. The electronic device includes a metal housing, a partition wall, a first antenna module, and a second antenna module. The metal housing has a T-shaped slot. The slot includes an opening end, a first closed end, and a second closed end. The partition wall is connected with the metal housing. The first antenna module has a first feeding element and a radiating element. The second antenna module has a second feeding element and an antenna array. The first antenna module and the second antenna module are respectively disposed on two sides of the partition wall, and the first antenna module is closer to the opening end than the second antenna module.

15 Claims, 9 Drawing Sheets

ELECTRONIC DEVICE AND ANTENNA STRUCTURE

CROSS-REFERENCE TO RELATED PATENT APPLICATION

This application claims the benefit of priority to Taiwan Patent Application No. 111100518, filed on Jan. 6, 2022. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an electronic device and an antenna structure, in particular to an electronic device and an antenna structure without an antenna clearance area.

BACKGROUND OF THE DISCLOSURE

With the rapid development of technology, consumers have higher performance requirements for communication products such as electronic devices (e.g., notebook computers). In addition, electronic devices not only become thinner and lighter in appearance design, but also need to have sufficient mechanical strength.

In order to meet the above-mentioned requirements, the electronic device needs to have enough space to arrange multiple antenna elements so that it can operate in different broadband operating frequency bands. In this case, how to solve the signal interference between different antenna elements is a big challenge. In addition, in general, an antenna clearance area needs to be arranged around the antenna element, that is, there should be no metal around the antenna element. However, this would conflict with the design of using a metal housing in order to achieve increased structural strength and a thin appearance.

Therefore, how to appropriately improve the design of the antenna structure to overcome the above-mentioned defects has become one of the important issues to be solved in this field.

SUMMARY OF THE DISCLOSURE

The technical problem to be solved by the present disclosure is how to arrange multiple antennas with different frequency bands in a limited space inside the electronic device, and solve the signal interference between different antennas.

In one aspect, the present disclosure provides an electronic device, which includes a metal housing, a partition wall, a first antenna module and a second antenna module. The metal housing has a T-shaped slot. The slot includes an opening end, a first closed end and a second closed end. The opening end is disposed between the first closed end and the second closed end. The partition wall is disposed between the first closed end and the second closed end, and the opening end is disposed between the first closed end and the partition wall. The partition wall is connected to the metal housing. The first antenna module has a first feeding element and a radiating element connected to the first feeding element, and the vertical projection of the radiating element on the metal housing at least partially overlaps with the slot. The second antenna module has a second feeding element and an antenna array, and the vertical projection of the antenna array projected on the metal housing at least partially overlaps the slot. The first antenna module and the second antenna module are respectively disposed on two sides of the partition wall, and the first antenna module is closer to the opening end than the second antenna module. The radiating element is fed with a signal through the first feeding element to generate a first operating frequency band. The antenna array is fed with another signal through the second feeding element to generate a second operating frequency band. The first operating frequency band is lower than the first operating frequency band.

In another aspect, the present disclosure provides an antenna structure, which is disposed in a metal housing. The metal housing has a T-shaped slot, the slot includes an opening end, a first closed end and a second closed end. The opening end is disposed between the first closed end and the second closed end. The antenna structure includes a first antenna module and a second antenna module. The first antenna module has a first feeding element and a radiating element connected to the first feeding element, and the vertical projection of the radiating element on the metal housing at least partially overlaps with the slot. The second antenna module has a second feeding element and an antenna array, and the vertical projection of the antenna array projected on the metal housing at least partially overlaps the slot. The first antenna module and the second antenna module are respectively disposed on two sides of a partition wall in the metal housing, and the first antenna module is closer to the opening end than the second antenna module. The radiating element is fed with a signal through the first feeding element to generate a first operating frequency band. The antenna array is fed with another signal through the second feeding element to generate a second operating frequency band, and the first operating frequency band is lower than the second operating frequency band.

Therefore, in the electronic device and the antenna structure provided by the present disclosure, by virtue of "the first antenna module and the second antenna module being respectively disposed on two sides of a partition wall in the metal housing, the radiating element being fed a signal through the first feeding element to generate a first operating frequency band, the antenna array being fed another signal through the second feeding element to generate a second operating frequency band, and the first operating frequency band being lower than the second operating frequency band," the adjacent first antenna module and the second antenna module have good characteristics and isolation performance when they are respectively excited.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
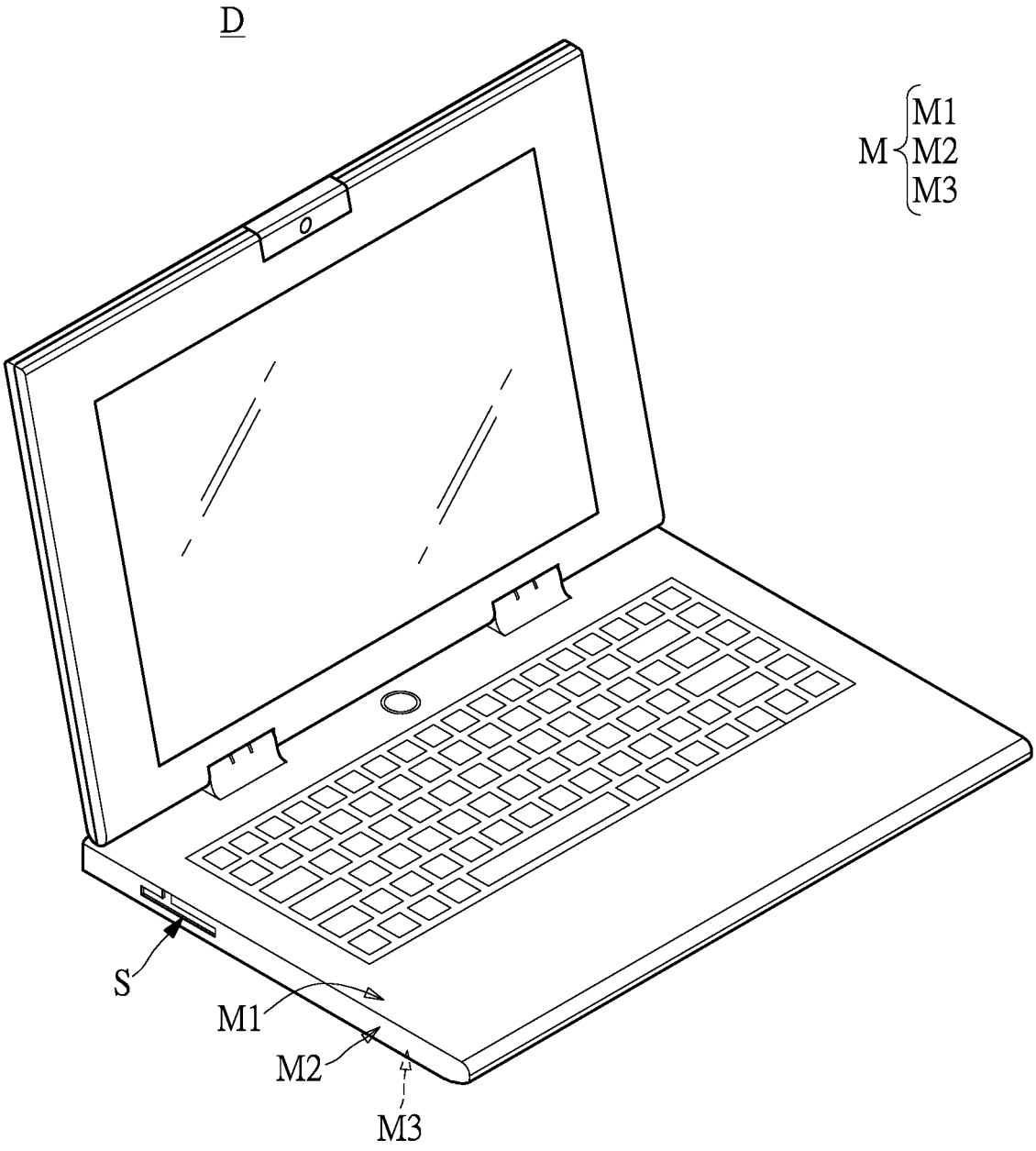
FIG. 1 is a schematic diagram of an electronic device of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like. In addition, the term "connect" used herein refers to a physical connection between two elements, which can be a direct connection or an indirect connection. The term "coupling to" used herein refers to two elements being separated and having no physical connection, and an electric field generated by a current of one of the two elements excites that of the other one.

Figure 2:
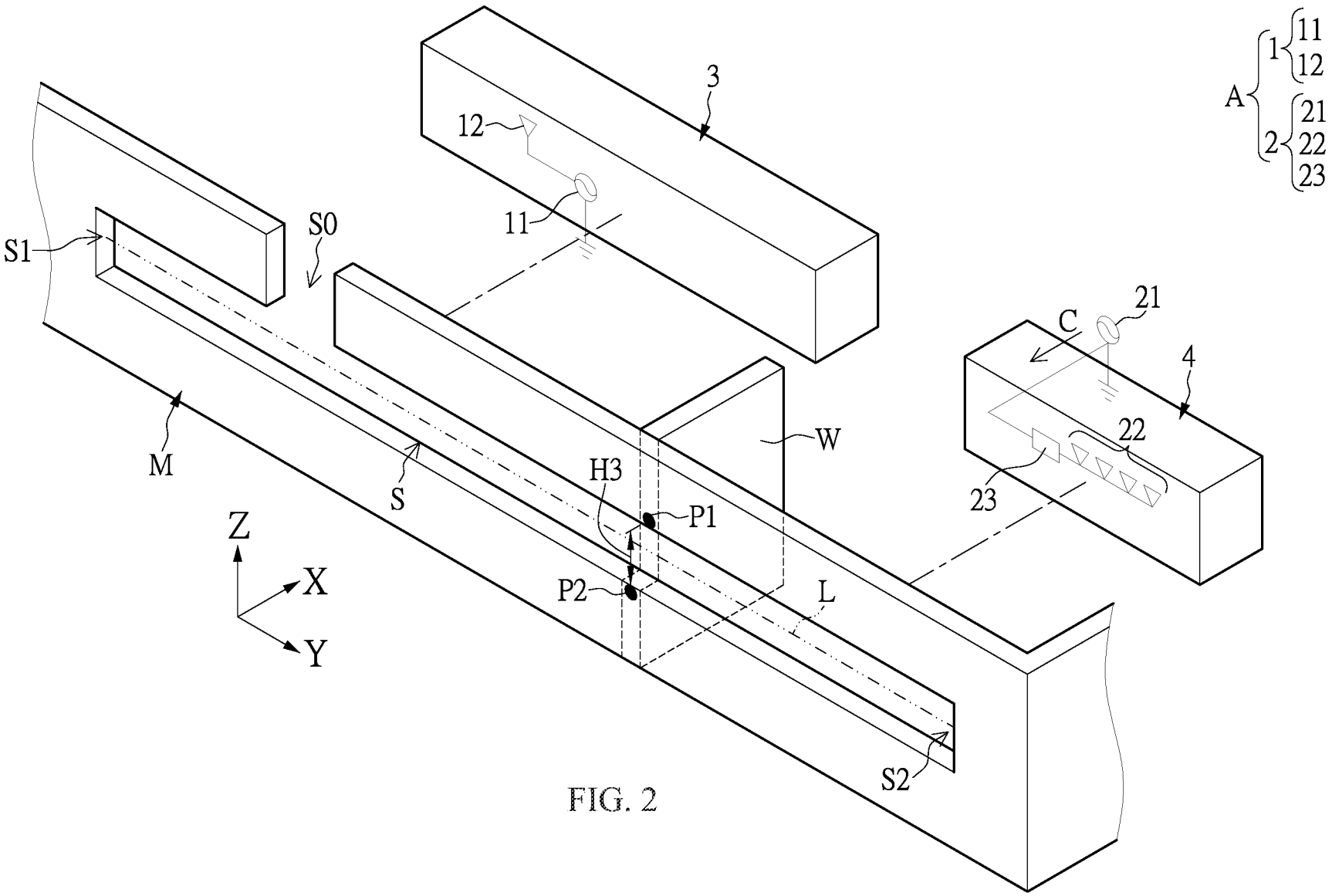
FIG. 2 is an exploded schematic diagram of an antenna structure in a first embodiment of the present disclosure.

Referring to FIG. 1, FIG. 1 is a schematic diagram of an electronic device of the present disclosure. The present disclosure provides an electronic device D. The electronic device D may be, for example, but not limited to, a notebook computer. The electronic device D includes a metal housing M, a partition wall W, and an antenna structure A (the antenna structure A is shown in FIG. 2). The antenna structure A is disposed in the metal housing M. The metal housing M has a slot S. The slot S is disposed on the side frame of the electronic device D as shown in FIG. 1. More specifically, the metal housing M may include a first side M1, a second side M2, and a third side M3, and the slot S is opened on the second side M2.

Figure 3:
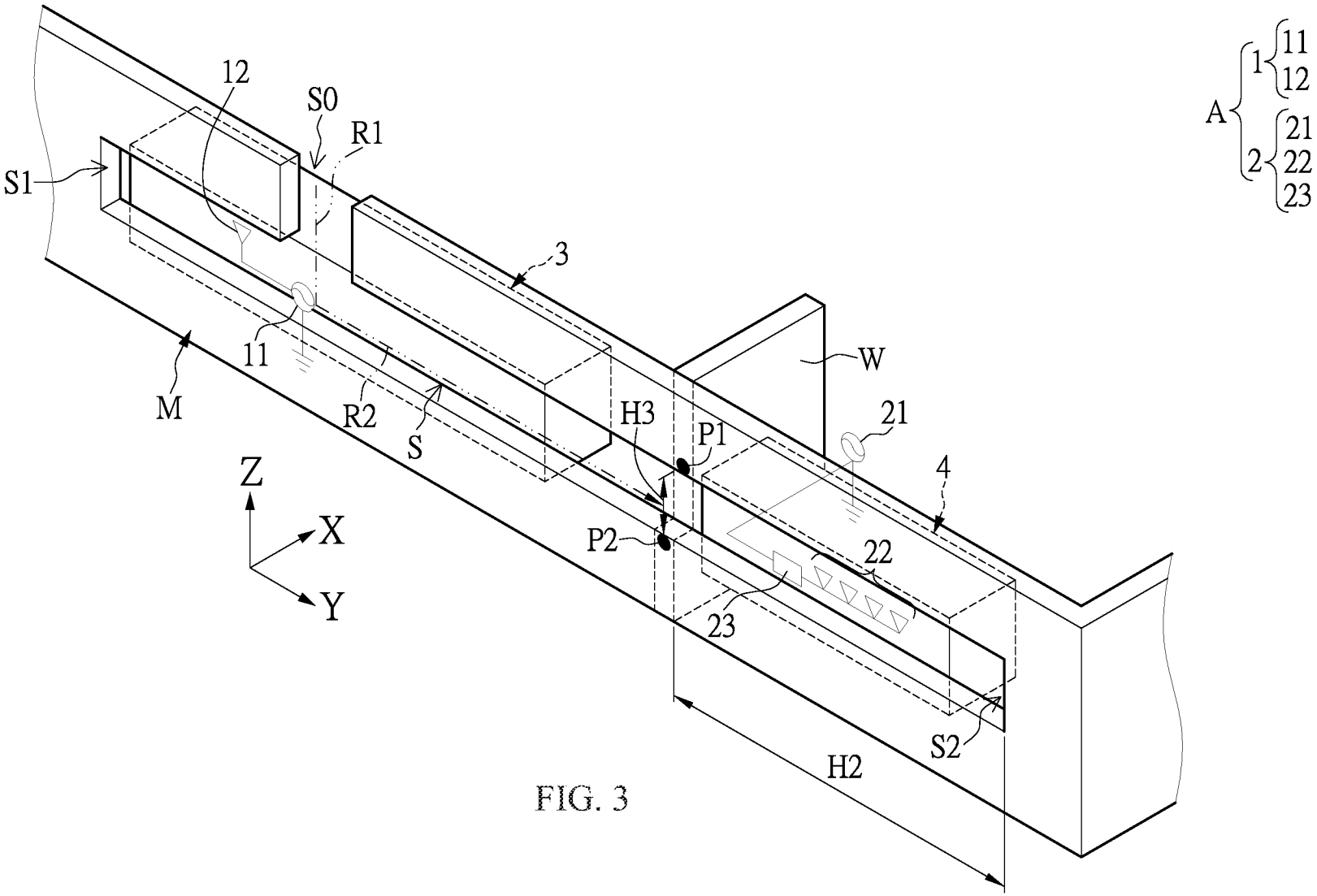
FIG. 3 is a schematic diagram of the antenna structure in the first embodiment of the present disclosure.

Next, referring to FIG. 2 and FIG. 3, FIG. 2 is an exploded schematic diagram of the antenna structure according to the first embodiment of the present disclosure, and FIG. 3 is a schematic diagram of the antenna structure according to the first embodiment of the present disclosure. FIG. 2 and FIG. 3 are enlarged positions of the slot S in FIG. 1 to show the relative positional relationship between the slot S and the antenna structure A. The slot S is in the shape of an inverted T shape, which has an opening end S0, a first closed end S1 and a second closed end S2. The opening end S0 is opened toward the upper cover of the electronic device D (i.e., toward the first side M1, see FIG. 1). The opening end S0 is disposed between the first closed end S1 and the second closed end S2 and is relatively close to the first closed end S1, so the slot S is actually an asymmetric slot structure. The partition wall W may be a metal retaining wall, connected to the metal housing M and disposed between the first closed end S1 and the second closed end S2. Further, the opening end S0 is disposed between the first closed end S1 and the partition wall W. More specifically, there is a first connection point P1 and a second connection point P2 between the partition wall W and the metal housing M, the first connection point P1 is located at the upper edge of the slot S, and the second connection point P2 is located at the lower edge of the slot S.

Referring to FIG. 2 and FIG. 3, the antenna structure A includes a first antenna module 1 and a second antenna module 2. The first antenna module 1 has a first feeding element 11 and a radiating element 12 connected to the first feeding element 11. The vertical projection of the radiating element 12 on the metal housing M at least partially, and preferably completely, overlaps with the slot S. The second antenna module 2 has a second feeding element 21 and an antenna array 22. The vertical projection of the antenna array 22 on the metal housing M at least partially, and preferably completely, overlaps with the slot S. The radiating element 12 of the first antenna module 1 is fed with a signal through the first feeding element 11 to generate a first operating frequency band, and the antenna array 22 of the second antenna module 2 is fed with another signal through the second feeding element 21 to generate a second operating frequency band, and the first operating frequency band is lower than the second operating frequency band. In addition, the radiating element 12 of the first antenna module 1 is also used to excite the slot S on the metal housing M to generate a third operating frequency band, and the third operating frequency band is lower than the first operating frequency band. In the present disclosure, the first operating frequency band and the third operating frequency band cover the frequency range of LTE and Sub-6G, and the second operating frequency band covers the millimeter wave (mmWave) frequency range. For example, the first frequency band of operation includes the frequency range of 3300 MHz to 5925 MHz, the third operating frequency band includes the frequency range of 1805 MHz to 2690 MHz, and the second operating frequency band includes the frequencies of 24.25 GHz to 28.35 GHz and 37 GHz to 40 GHz scope, but the present disclosure is not limited.

As mentioned above, the electronic device D may further include the first carrier board 3 and the second carrier board 4 disposed in the metal housing M. The first carrier board 3 and the second carrier board 4 are respectively located on two sides of the partition wall W, the radiating element 12 is disposed on the first carrier board 3, and the antenna array 22 is disposed on the second carrier board 4. Therefore, the first antenna module 1 and the second antenna module 2 are disposed on two sides of the partition wall W and are separated by the partition wall W respectively. The partition wall W is used to separate the first antenna module 1 and the second antenna module 2, so that the adjacent first antenna module 2 and the second antenna module 3 are respectively excited and both have good antenna efficiency and better isolation performance (that is, reducing signal interference between the first antenna module 1 and the second antenna module 2).

Referring to FIG. 3, in the present disclosure, the opening end S0 is relatively close to the first antenna module 1. Further, the slot S structure may be divided into a part parallel to the Z axis (i.e., the part at the opening end S0) and another part parallel to the Y axis (i.e., the part between the first closed end S1 and the second closed end S2), The resonance path generated by the radiating element 12 excited by the slot S would first pass through the part of the slot S parallel to the Z axis, and then pass through the part of the slot S parallel to the Y axis. Specifically, the resonance path can be divided into a path R1 and a path R2, the path R1 extends from the middle position of the opening end S0 along the negative Z-axis direction to a central axis of the slot S, and the path R2 is formed along the In the positive Y-axis direction, it extends to the middle position between the first connection point P1 and the second connection point P2 of the partition wall W, and the path R1 and the path R2 are respectively along the central axis of the slot S (that is, the path R1 is along the opening end S0 of the slot S and the path R2 is along the central axis between the first closed end S1 and the second closed end S2), so that the resonance path is in an L-shape. The length of the resonance path is less than ¼ wavelength of a lowest operating frequency in the third operating frequency band, and the distance between the first closed end S1 and the partition wall W is less than a lowest operating frequency in the third operating frequency band. ¼ wavelength of the operating frequency. The present disclosure further enables the mode excited by the first antenna module 1 to have good antenna efficiency through the structural design that the length of the resonance path is less than ¼ wavelength of the lowest operating frequency in the third operating frequency band.

In addition, the distance H2 between the second closed end S2 and the partition wall W is greater than twice the wavelength of a lowest operating frequency in the second operating frequency band. The distance H3 between the first connection point P1 and the second connection point P2 is greater than ¼ wavelength of a lowest operating frequency (e.g., 24.25 GHz) in the second operating frequency band. Therefore, the present disclosure makes the size of the slot S large enough through the structural design of the distance H2 between the second closed end S2 and the partition wall W and the distance H3 between the first connection point P1 and a second connection point P2, so that the operation of the antenna array 22 is not limited by the slot S and has good radiation performance.

Figure 4:
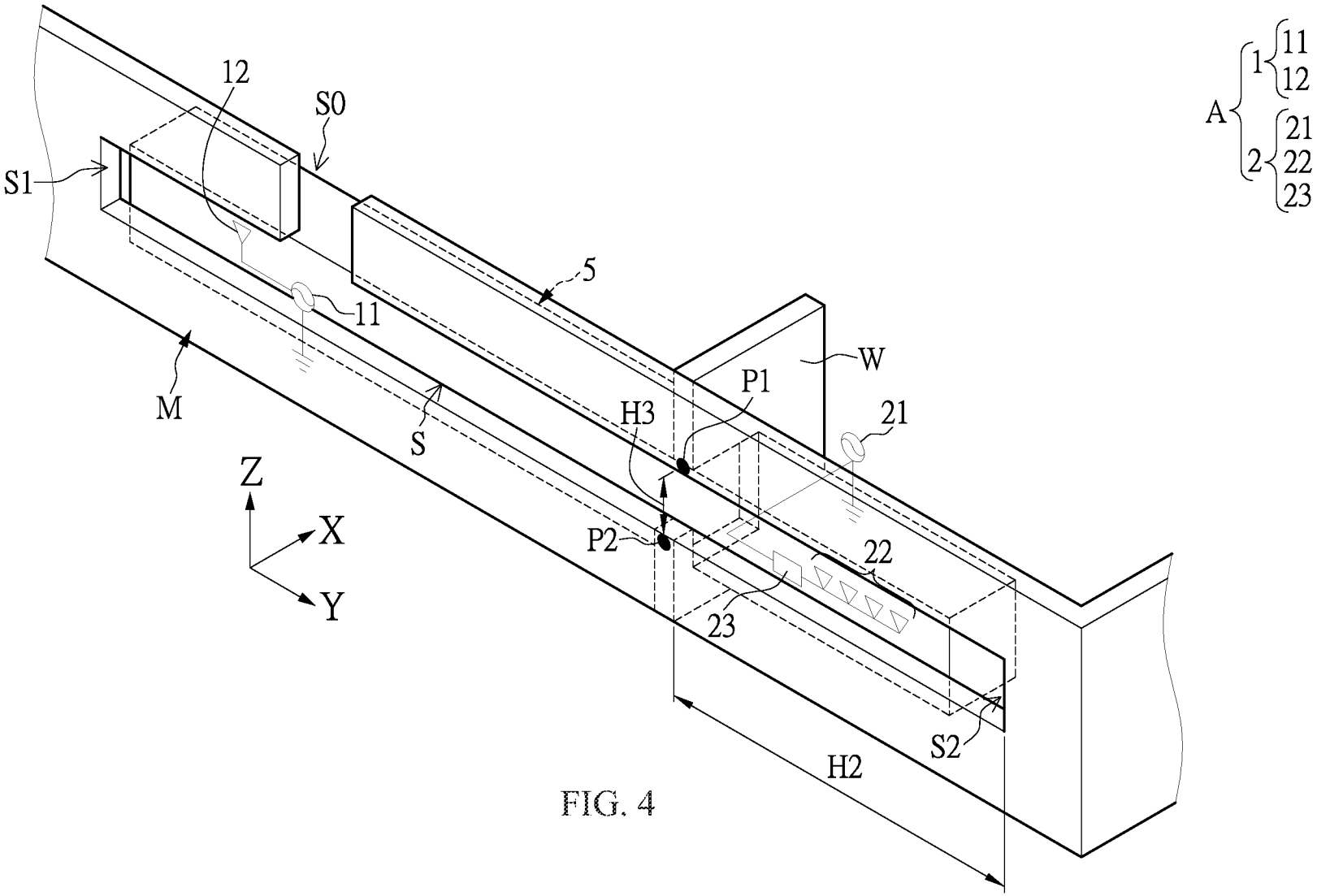
FIG. 4 is a schematic diagram of the antenna structure in the second embodiment of the present disclosure.
Figure 5:
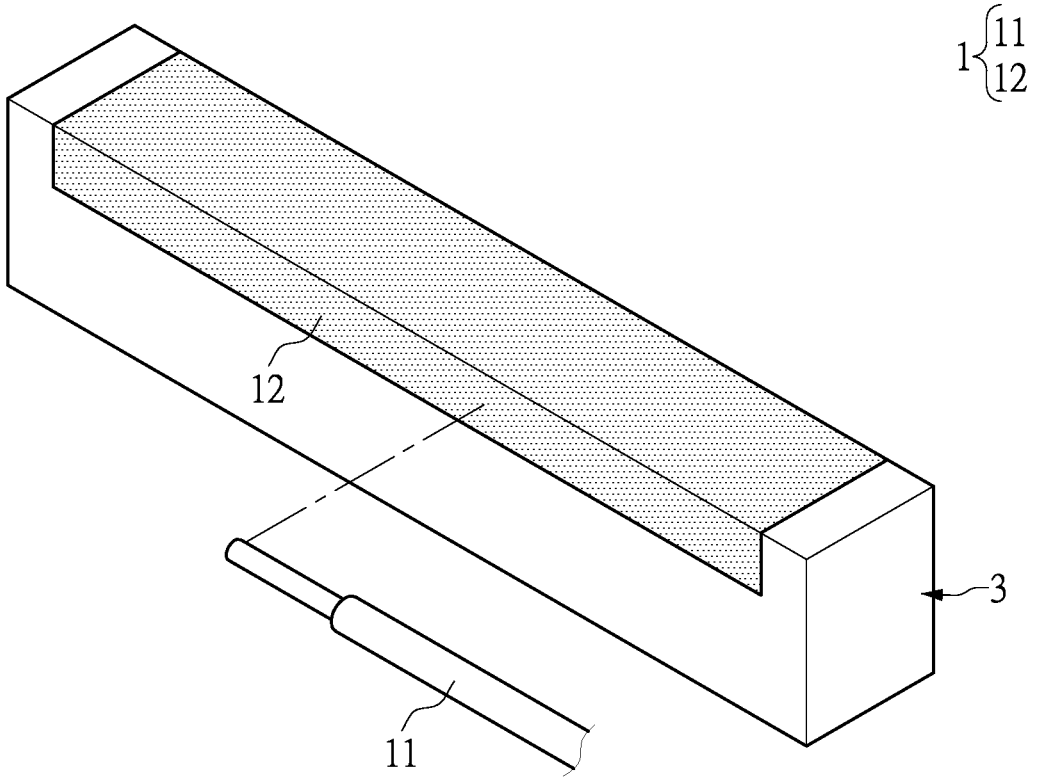
FIG. 5 is a schematic diagram of one embodiment of the first antenna module of the present disclosure.
Figure 6:
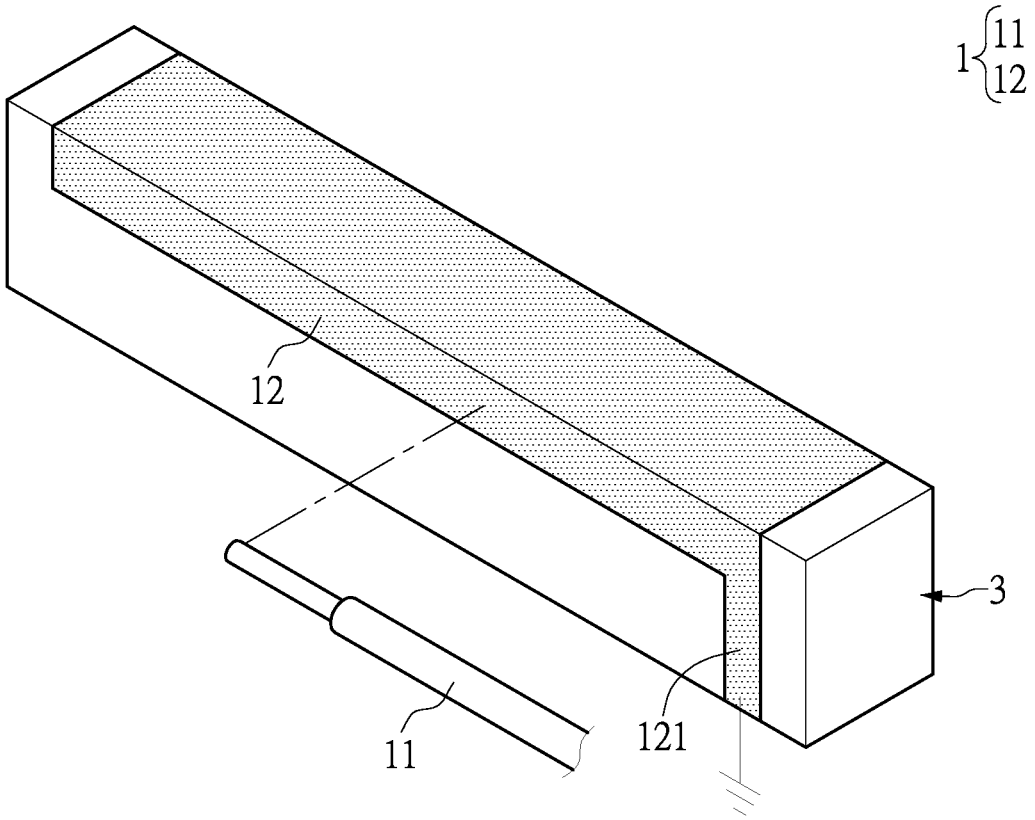
FIG. 6 is a schematic diagram of another embodiment of the first antenna module of the present disclosure.

Referring to FIG. 4, FIG. 4 is a schematic diagram of an antenna structure according to a second embodiment of the present disclosure. Different from the first embodiment shown in FIG. 2 and FIG. 3, in the second embodiment shown in FIG. 4, the electronic device D may include a third carrier board 5 disposed in the metal housing M, the third carrier board 5 penetrates the partition wall W (or the partition wall W surrounds the third carrier board 5), and the radiating element 12 and the antenna array 22 are disposed on the third carrier board 5. That is to say, the present disclosure is not limited to the type of the carrier, and the radiating element 12 and the antenna array 22 may be disposed on different carriers (the first carrier 3 and the second carrier 4), or may also be disposed on a single carrier (third carrier board 5). In addition, it should be noted that the present disclosure is not limited to the implementation of the radiating element 12. Referring to FIG. 5 and FIG. 6, FIG. 5 and FIG. 6 are schematic diagrams of different implementations of the first antenna module 1 of the present disclosure. For example, as shown in FIG. 5, the radiating element 12 may be a monopole antenna. Alternatively, as shown in FIG. 6, the radiating element 12 may be an Inverted-F Antenna (IFA), which is grounded through the grounding portion 121.

Figure 7:
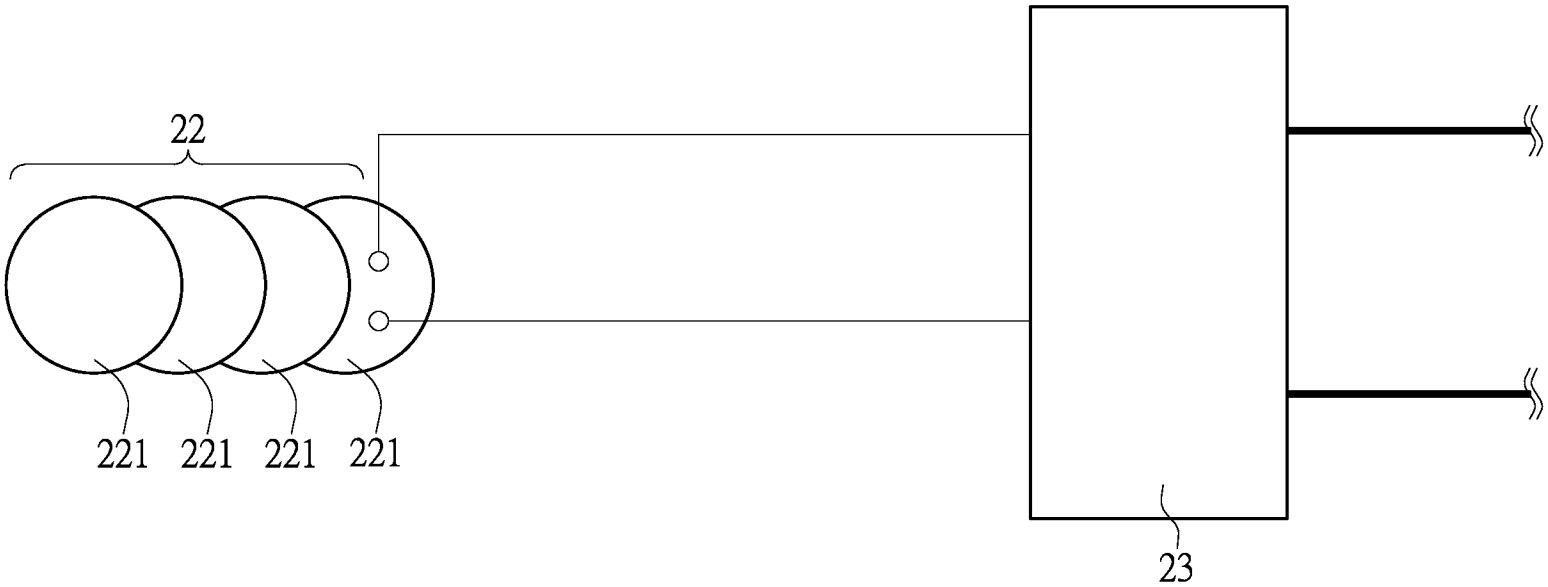
FIG. 7 is a schematic diagram of an antenna array and a control circuit of a second antenna module of the present disclosure.

Referring to FIG. 2, FIG. 3 and FIG. 7, FIG. 7 is a schematic diagram of the antenna array and the control circuit of the second antenna module of the present disclosure. Specifically, the antenna array 22 includes a plurality of antenna elements 221, and the antenna array 22 in FIG. 7 includes four antenna elements 221, but the present disclosure is not limited thereto. In addition, each antenna unit 221 in FIG. 7 is a circular patch antenna, but the present disclosure is not limited thereto. The antenna array 22 can excite two mutually orthogonal radiation patterns through the design of the plurality of antenna elements 221, for example, one radiation pattern is in a horizontal polarization direction and the other radiation pattern is in a vertical polarization direction. In the present disclosure, the second feeding element 21 may be, for example, an intermediate frequency (Intermediate Frequency, IF) signal line. The second feeding element 21 is extended and connected to the antenna array 22 along a first direction C (parallel to the X-axis direction), and the slot S can define a first axis L between the first closed end S1 and the second closed end S2 (parallel to the Y-axis direction), and the first direction C is orthogonal to the first axis L (see FIG. 2). Therefore, in the present disclosure, the extending direction of the second feeding element 21 can be perpendicular to the first axis L, so as to reduce the energy between the second feeding element 21 (the intermediate frequency signal line) and the surrounding environment (such as the slot S) coupling, thereby reducing energy loss. If the feeding direction of the second feeding member 21 is not orthogonal to the first axis L, the second feeding member 21 may excite the slot S to generate fundamental frequency or frequency multiplication energy loss. In addition, the second antenna module 2 further includes a control circuit 23 in addition to the second feeding element 21 and the antenna array 22. The control circuit 23 may control the amplitude and phase of the two radiation patterns. Further, the control circuit 23 may convert the signal generated by the second feeding element 21 into millimeter waves (that is, convert the intermediate frequency into high frequency), and make the plurality of antenna units 221 excite electromagnetic waves with a specific amplitude and phase, and then the beam of the antenna array 22 is controlled to improve the field coverage rate of the antenna array 22.

Beneficial Effects of the Embodiments

One of the beneficial effects of the present disclosure is that in the electronic device D and the antenna structure A provided by the present disclosure, the technical solution of the first antenna module 1 and the second antenna module 2 being respectively disposed on two sides of a partition wall W in the metal housing M, the radiating element 12 being fed a signal through the first feeding element 11 to generate a first operating frequency band, the antenna array 22 being fed another signal through the second feeding element 21 to generate a second operating frequency band, and the first operating frequency band being lower than the second operating frequency band so that the adjacent first antenna module 1 and the second antenna module 2 have good characteristics and isolation performance when they are respectively excited.

Furthermore, in the present disclosure, pursuant to the appearance design of the electronic device D with a light and thin appearance and mechanical strength, the internal antenna structure A is disposed on the frame of the metal housing M and does not have a clearance area (specifically, as long as one of the upper surface or the lower surface of the metal housing M is made of metal material, it does not have a clearance area). Therefore, in order to prevent the performance of the antenna structure A from being affected by the zero clearance area, the present disclosure utilizes the design of the slot S, so that the first antenna module 1 and the second antenna module 2 share the slot S, so that the first antenna module 1 and the second antenna module 2 share the slot S. The radiating element 11 of the antenna module 1 itself can not only be fed the signal through the first feeding element 11 to generate the first operating frequency band and generate the third operating frequency band through exciting the slot S but also allowing the antenna array 22 of the second antenna module 2 utilizes the slot S as a radiation region to generate a second operating frequency band.

Furthermore, since the antenna structure A including the first antenna module 1 and the second antenna module 2 shares the slot S and is adjacent to each other, in order to reduce the signal interference between the first antenna module 1 and the second antenna module 2, the present disclosure sets a metal partition wall W between the first antenna module 1 and the second antenna module 2, and the partition wall W is connected to the metal housing M. Through the design of the distance between the partition wall W, the opening end S0 and the second closed end S2, the resonance path of the excitation slot S of the first antenna module 1 may be clearly defined, and the second antenna module 2 also has enough space to operate to get good radiation characteristics. More importantly, the isolation between the first antenna module 1 and the second antenna module 2 can also be improved by the property of the partition wall W to block electromagnetic waves.

Figure 8:
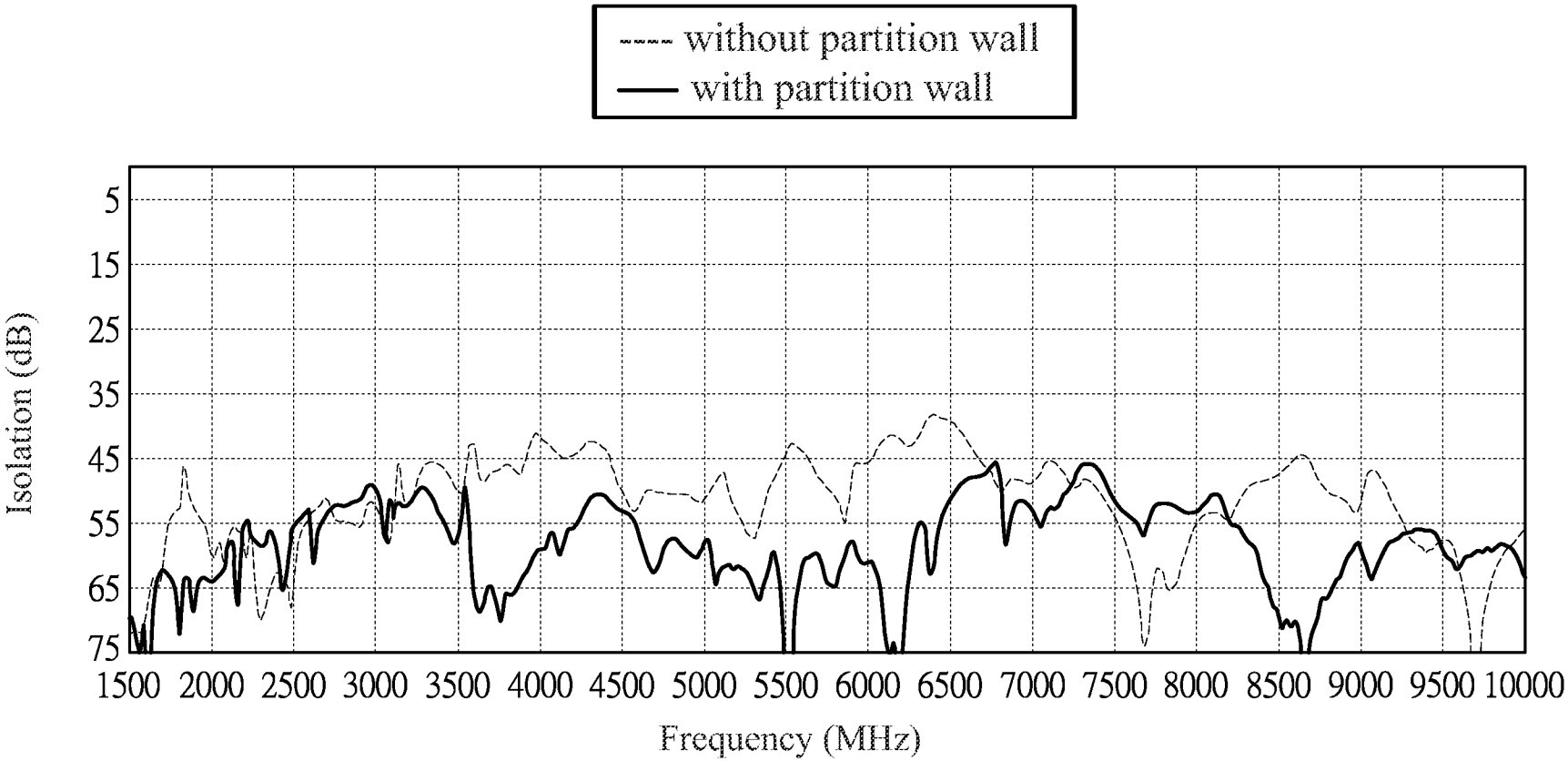
FIG. 8 is a schematic diagram of isolation in the horizontal polarization direction of the second antenna module of the present disclosure.
Figure 9:
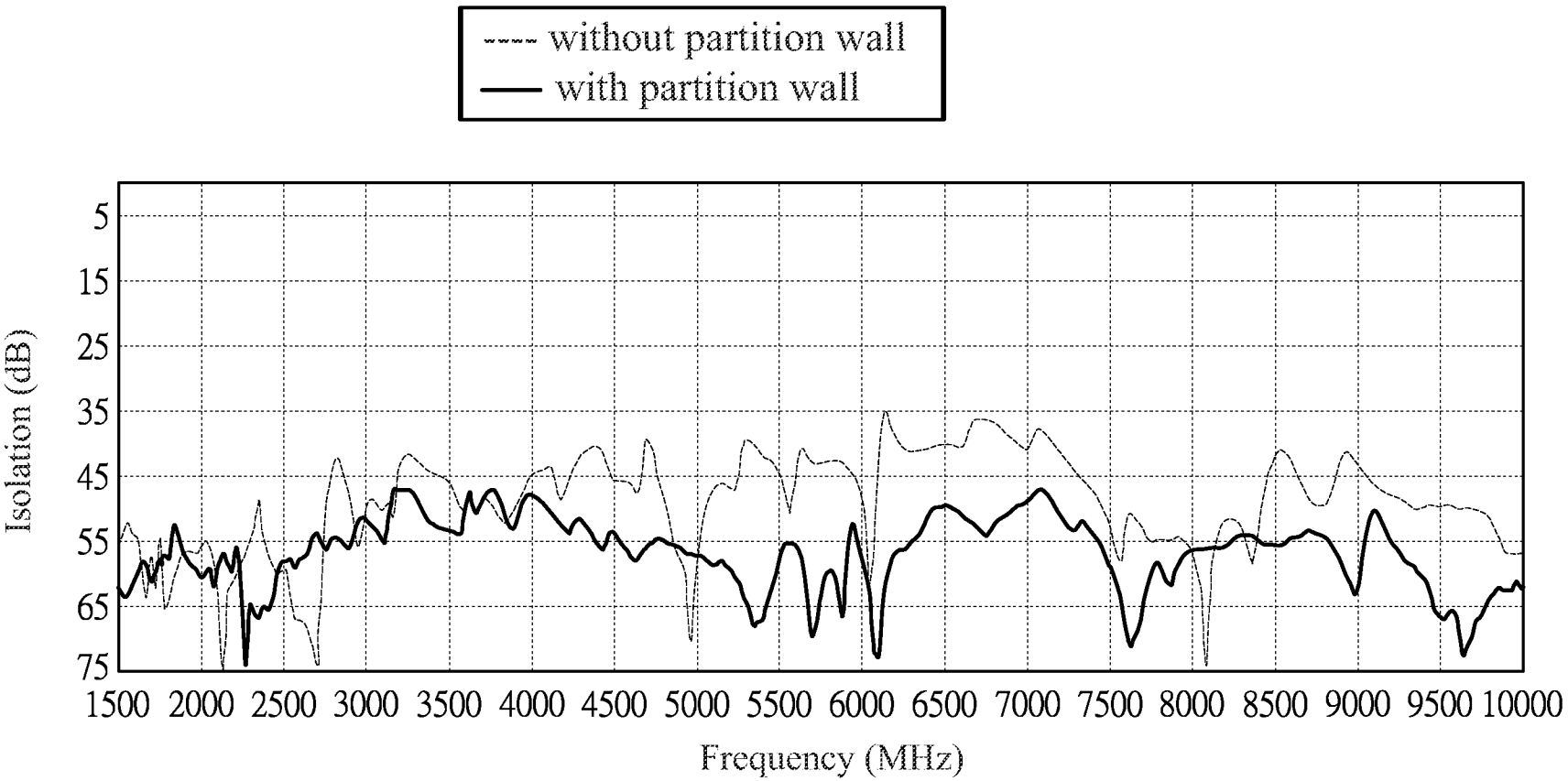
FIG. 9 is a schematic diagram of isolation in the vertical polarization direction of the second antenna module of the present disclosure.

Referring to FIG. 8 and FIG. 9, FIG. 8 is a schematic diagram of the isolation degree of the horizontal polarization direction of the second antenna module of the present disclosure. FIG. 9 is a schematic diagram of the isolation of the vertical polarization direction of the second antenna module of the present disclosure. As can be seen from FIG. 8 and FIG. 9, the isolation performance of the second antenna module 2 of the antenna structure A of the present disclosure in the horizontal polarization direction and the vertical polarization direction when there is a partition wall W and when there is no partition wall W, It can be seen that the isolation degree is obviously better when there is a partition wall W.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electronic device, comprising:

a metal housing, the metal housing having a T-shaped slot, the slot having an opening end, a first closed end and a second closed end, and the opening end disposed between the first closed end and the second closed end;

a partition wall, connected to the metal housing and disposed between the first closed end and the second closed end, and the opening end disposed between the first closed end and the partition wall;

a first antenna module, having a first feeding element and a radiating element connected to the first feeding element, and a vertical projection of the radiating element on the metal housing at least partially overlapping the slot; and a second antenna module, having a second feeding element and an antenna array, and a vertical projection of the antenna array on the metal housing at least partially overlapping the slot;

wherein the first antenna module and the second antenna module are respectively disposed on two sides of the partition wall, the first antenna module is closer to the opening end than the second antenna module, the radiating element is fed with a signal through the first feeding element to generate a first operating frequency band, the antenna array is fed with another signal through the second feeding element to generate a second operating frequency band, and the first operating frequency band is lower than the second operating frequency band.

2. The electronic device according to claim 1, wherein the radiating element is a monopole antenna or an inverted-F antenna, the radiating element is used to excite the slot to generate a third operating frequency band, and the third operating frequency band is lower than the first operating frequency band.

3. The electronic device according to claim 2, wherein the first operating frequency band and the third operating frequency band cover the frequency range of LTE and Sub-6G, and the second operating frequency band covers the frequency range of mmWave.

4. The electronic device according to claim 2, wherein the radiating element is used to excite the slot to generate a resonance path, the length of the resonance path is less than ¼ wavelength of a lowest operating frequency within the third operating frequency band, and a distance between the first closed end and the partition wall is less than ¼ wavelength of the lowest operating frequency within the third operating frequency band.

5. The electronic device according to claim 1, wherein the second antenna module further comprises a control circuit, the antenna array includes a plurality of antenna elements, the antenna array is used to excite two mutually orthogonal radiation patterns, and the control circuit is used to control the amplitude and the phase of the two radiation patterns.

6. The electronic device according to claim 1, wherein the second feeding element is an intermediate frequency signal line, the second feeding element is extended and connected to the antenna array along a first direction, the slot defines a first axis between the first closed end and the second closed end, and the first direction is orthogonal to the first axis.

7. The electronic device according to claim 1, further comprising a first carrier board and a second carrier board disposed in the metal housing, the first carrier board and the second carrier board being respectively located on both sides of the partition wall, the radiating element disposed on the first carrier board, and the antenna array disposed on the second carrier board.

8. The electronic device according to claim 1, further comprising a third carrier board disposed in the metal housing, the third carrier board penetrating the partition wall, and the radiating element and the antenna array disposed on the third carrier board.

9. The electronic device according to claim 1, wherein a distance between the second closed end and the partition wall is greater than twice the wavelength of a lowest operating frequency in the second operating frequency band.

10. The electronic device according to claim 1, wherein a first connection point and a second connection point are between the partition wall and the metal housing, the first connection point is located at the upper edge of the slot, the second connection point is located at the lower edge of the slot, a distance between the first connection point and the second connection point is greater than ¼ wavelength of a lowest operating frequency in the second operating frequency band.

11. An antenna structure, disposed in a metal housing, the metal housing having a T-shaped slot, the slot having an opening end, a first closed end and a second closed end, and the opening end disposed between the first closed end and the second closed end, the antenna structure comprising:

a first antenna module, having a first feeding element and a radiating element connected to the first feeding element, and a vertical projection of the radiating element on the metal housing at least partially overlapping the slot; and a second antenna module, having a second feeding element and an antenna array, and a vertical projection of the antenna array on the metal housing at least partially overlapping the slot;

wherein the first antenna module and the second antenna module are respectively disposed on two sides of a partition wall in the metal housing, the first antenna module is closer to the opening end than the second antenna module, the radiating element is fed with a signal through the first feeding element to generate a first operating frequency band, the antenna array is fed with another signal through the second feeding element to generate a second operating frequency band, and the first operating frequency band is lower than the second operating frequency band.

12. The antenna structure according to claim 11, wherein the radiating element is a monopole antenna or an inverted-F antenna, the radiating element is used to excite the slot to generate a third operating frequency band, and the third operating frequency band is lower than the first operating frequency band.

13. The antenna structure according to claim 12, wherein the first operating frequency band and the third operating frequency band cover the frequency range of LTE and Sub-6G, and the second operating frequency band covers the frequency range of mmWave.

14. The antenna structure according to claim 11, wherein the second antenna module further comprises a control circuit, the antenna array includes a plurality of antenna elements, the antenna array is used to excite two mutually orthogonal radiation patterns, and the control circuit is used to control the amplitude and the phase of the two radiation patterns.

15. The antenna structure according to claim 11, wherein the second feeding element is an intermediate frequency signal line, the second feeding element is extended and connected to the antenna array along a first direction, the slot defines a first axis between the first closed end and the second closed end, and the first direction is orthogonal to the first axis.

* * * * *